US005362052A

United States Patent [19]

Kubatsch

[11] Patent Number: 5,362,052

[45] Date of Patent: Nov. 8, 1994

[54] DRIVE MECHANISM FOR A SYMBOL-CARRYING SYMBOL CARRIER

[75] Inventor: Gunter Kubatsch, Berlin, Germany

[73] Assignee: Bally Wulff Automaten GmbH, Berlin, Germany

[21] Appl. No.: 83,018

[22] Filed: Jun. 25, 1993

Related U.S. Application Data

[63] Continuation-in-part of Ser. No. 846,514, Mar. 4, 1992, abandoned.

[51] Int. Cl.[5] ..... A63F 9/04; A63F 9/24

[52] U.S. Cl. ..... 273/145 R; 273/138 A

[58] Field of Search ..... 273/138 A, 143 R, 145; 40/414, 430, 473

[56] References Cited

U.S. PATENT DOCUMENTS 858,452 2/1907 Harding ..... 40/473
3,039,615 6/1962 Vihlein et al. ..... 40/473

FOREIGN PATENT DOCUMENTS 2147510 5/1985 United Kingdom ..... 273/138 A

*Primary Examiner*—Benjamin H. Layno
*Attorney, Agent, or Firm*—Basile and Hanlon

[57] ABSTRACT

A drive mechanism with a symbol-carrying, rotary symbol carrier, particularly for use in coin-operated gaming machines. The drive mechanism for the symbol carrier is a motor-gear combination, which drives the symbol carrier in such a way that it rotates about two rotation axes.

15 Claims, 5 Drawing Sheets

DRIVE MECHANISM FOR A SYMBOL-CARRYING SYMBOL CARRIER

CROSS REFERENCE TO CO-PENDING APPLICATION

This application is a continuation-in-part of co-pending U.S. patent application Ser. No. 07/846,514, filed Mar. 4, 1992, in the name of Gunter Kubatsch now abandoned.

BACKGROUND OF THE INVENTION

Field of the Invention

The present invention relates to a drive mechanism for a symbol-carrying, rotary symbol carrier and, more particularly, for use in a coin-operated gaming machine.

Background Description

Different types of symbol carrier drive mechanisms are used in gaming machines. Usually there are several symbol carriers constructed in a roller or a disk-like manner and on whose surfaces are provided different symbols. At the start of the game the symbol carrier drive mechanisms are controlled by a control mechanism, which starts the drive mechanisms revolving and, after a chance-based stoppage, it is established by means of the symbol combination visible on the display panel whether or not the player has won. By means of a win plan the player can read off whether the played symbol combination represents a win or a loss. Conventional symbol carriers are constructed as rollers or disks, which perform a circular movement in a plane, a stepping motor being provided which rotates the symbol carriers.

The problem of the present invention is to provide a drive mechanism for a symbol carrier which allows a novel type of symbol carrier movement.

SUMMARY OF THE INVENTION

This problem is solved in that the symbol carrier drive mechanism has a motor-gear combination which drives the symbol carrier in such a way that it rotates about two rotation axes.

Advantageous further developments and improvements are also possible. Due to the fact that the shaft located in the extension of the diagonal axis of the symbol carrier or dice is not rotatable in a fixed bearing, but, instead, is fixed to the end of a crank, and the bevel or toothed gear fixed to the shaft end is in operative connection with a second driven toothed gear or a fixed bevel gear or by means of a toothed belt, when the crank is driven, there is a rotation of the symbol carrier or dice both about its own axis and also about that of the crank. If, in preferred manner, such axis is so inclined with respect to that of the crank that the center of the symbol carrier or dice is located above the crank axis, not only are the symbols arranged on the equator of the dice directed towards a fixed observation direction, e.g., towards the display window of a gaming machine, but also those symbols located on the wide circles are also similarly directed. By matching the transmission ratios and angular position of the drive shaft or axis to the symbol carrier or dice shaft located in the diagonals, it is possible to allow each symbol to appear at the display window. A light barrier is preferably provided for detecting a reference position of the drive shaft or symbol carrier.

Unlike the case of simply rotating symbol carriers when used in gaming machines, as a result of the rotation of the symbol carrier about several axes, the playing sequence on the gaming machine becomes more interesting and entertaining. In addition, when using a dice, both in the gaming machine as a symbol carrier and also in a dice mechanism, the natural "rolling" of a dice is imitated.

BRIEF DESCRIPTION OF THE DRAWINGS

The invention is described in greater detail hereinafter relative to non-limitative embodiments and the attached drawings, wherein.

DESCRIPTION OF THE PREFERRED EMBODIMENTS

Figure 1:
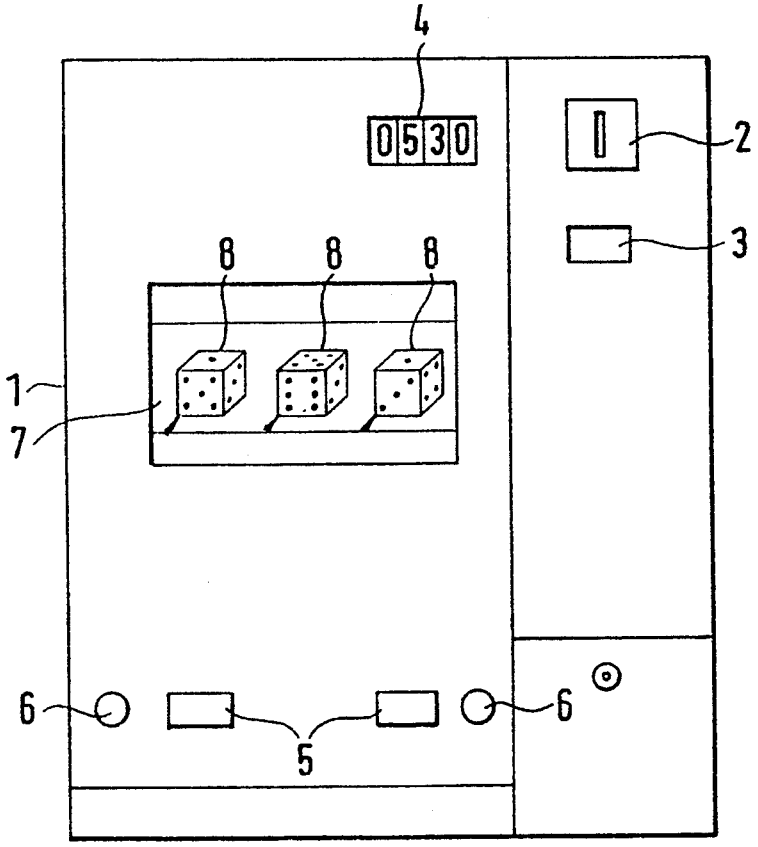
FIG. 1 is a plan view of a gaming machine in which several drive mechanisms for symbol carriers according to the present invention are used.

FIG. 1 shows a coin-operated gaming machine 1 which has a coin insertion slot 2, a coin ejector 3, a counter 4 for counting and displaying the amounts of money still available for games, and stop and start buttons or keys 5, with which are associated corresponding display elements 6. Obviously the gaming machine 1 can have additional means, such as risk playing, special playing, joker playing means and the like, which are not represented in detail. Behind the display panel 7 there are three symbol carriers 8, which are constructed as dies and also carry dice symbols. The symbol carriers 8 can also be constructed as other geometrical bodies and can carry different symbols.

Figure 2:
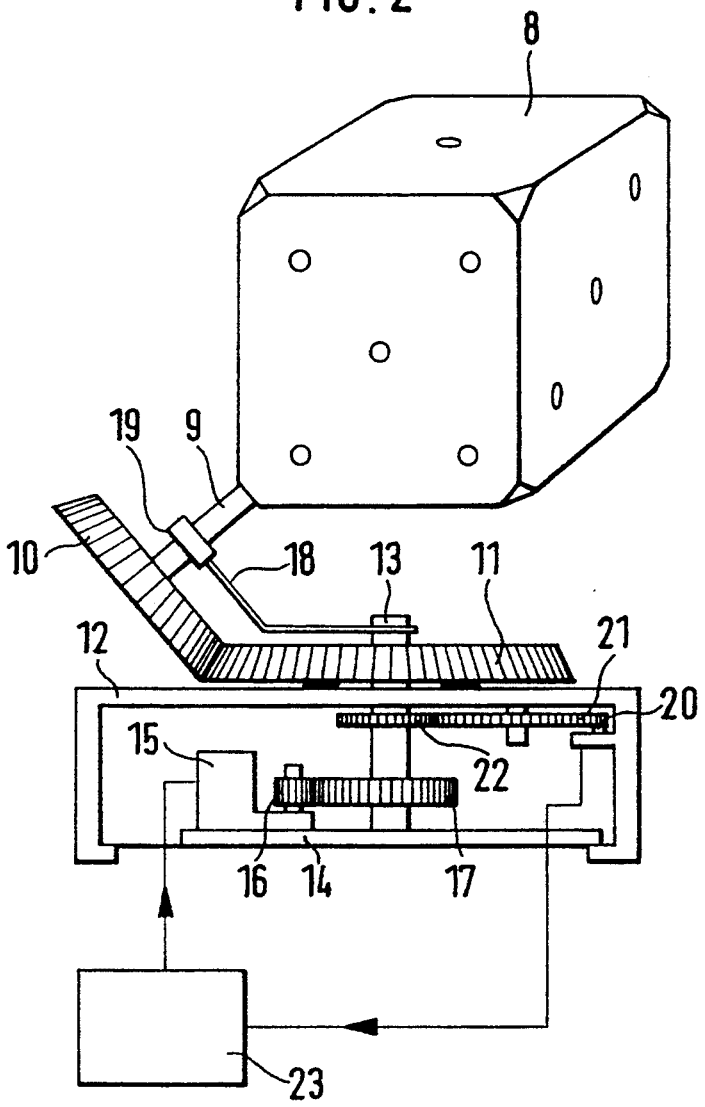
FIG. 2 is a diagrammatic view of a die with its drive mechanism according to a first embodiment of the present invention.

A first embodiment of the symbol carrier 8 in the form of a die is shown in FIG. 2 and with the six die faces there are associated spot or dot combinations from one to six, respectively. In the extended space diagonal of the die 8 a shaft 9 is fixed to the die 8 and on its end remote from the die 8 it rigidly carries a bevel gear 10. A second bevel gear 11 is firmly connected to a frame 12 and is centrally traversed by a rotary drive shaft 13. The first bevel gear 10 is in engagement with the fixed second bevel gear 11.

On a baseplate 14 of the frame 12 there is provided a stepping motor 15 which rotates a driving toothed gear 16, which is in engagement with a toothed wheel 17 firmly located on the drive shaft 13, so that the rotation of the tooth wheel 16 is transmitted to the drive shaft 13. A lever arrangement constructed in the form of a bent crank 18 is firmly placed on the drive shaft 13 and has at one end a ball bearing 19 in which rotates the shaft 9 of the die 8.

A light barrier 20 is provided for establishing a reference position of the overall drive mechanism and is interrupted by a further toothed wheel 21, which is mounted in rotary manner in the frame 12 and which is driven by a further toothed wheel 22 firmly placed on the drive shaft 13. At the reference position the toothed wheel 21 has an aperture so that a pulse is generated through the light barrier 20.

The stepping motor 15 and the light barrier 20 are connected to a control mechanism 23 which controls the movement of the drive mechanism. The control mechanism 23 is, for example, constructed as a microprocessor or a microcomputer which stores information concerning the transmission ratios or numbers of teeth of the individual toothed gears or wheels 16, 17, 21, 22 and bevel gears 10 and 11, as well as information concerning the operation of the stepping motor 15. Taking account of this information, the control mechanism 23 can control in a planned manner any random position of the die 8.

The bevel gear 10 engages the bevel gear 11 at an angle of 126° and the die 8 arrangement is preferably selected in such a way that the center of the die 8 is located above the center axis of the drive shaft 13. As each side of the die 8 is to be rendered visible at the display window or panel 7 and from the observation direction, a specific transmission ratio of the two bevel gears 10, 11 must be chosen. The transmission ratio is such that in the case of a $\frac{1}{4}$ turn of the crank 18 or the drive shaft 13 one side of the die 8 becomes visible and the bevel gear 10 performs a $\frac{2}{3}$ turn. After $1\frac{1}{2}$ rotations of the drive shaft 13 the movement of the die 8 starts from the front. This means that the transmission ratio of the two bevel gears 10, 11 is such that in the case of one or more $\frac{1}{4}$ turns of the crank 18, there are one or more, but not dividable by three, $\frac{1}{3}$ rotations of the shaft 9 about the diagonal axis of the die 8.

In the embodiment, the light barrier 20 with a toothed gear 21 is used for fixing the reference position. It would obviously be possible to use other sensors, e.g., magnetic or inductive sensors with corresponding interrupt elements.

The playing sequence for a gaming machine according to FIG. 1 with dies as the symbol carriers according to FIG. 2 is as follows. On inserting one or more coins or tokens into the coin slot 2 of the gaming machine 1 or on debiting the necessary amount from the coin counter 4, the control mechanism 23 controls the stepping motor 15 and the light barrier 20 supplies the reference pulse to the control mechanism 23 at the reference position with which is also associated a given position of the die 8. The drive shaft 13 is driven by means of the toothed gears 16, 17 and the bevel gear 10 is put into movement by means of the crank 18 on the circular path of the external diameter of the bevel gear 11. Simultaneously, the rotation resulting from the engagement of the bevel gear 10 in bevel gear 11 is transmitted via the shaft 9 to the dice 8, which consequently additionally rotates about its diagonal axis. The rotation of the drive shaft 13 is either stopped after a fixed time predetermined by the control mechanism 23, or as a function of specific positions in the control mechanism 23 decided beforehand by means of a chance machine or randomizer. The symbols can then be seen in the display window 7. If the control mechanism 23 determines the positions of the symbol carriers or dies 8 at the start of playing, by comparing a sorted win plan it is simultaneously possible to establish whether or not there is a win combination. As a function of the predetermined positions of the dies 8 and the stored information concerning the transmission ratios, the control mechanism 23 supplies the necessary number of pulses for controlling the specific positions on the stepping motor 15. If the symbol carriers 8 are stopped after a predetermined, fixed time, by means of the pulses from the light barrier 20 and the number of control pulses supplied to the stepping motor 15, as well as information concerning the application of the symbols to the dies 8, the control mechanism determines the symbol combination displayed on the display window 7 and compares it with the stored win plan to establish whether or not there is a win combination.

Figure 3:
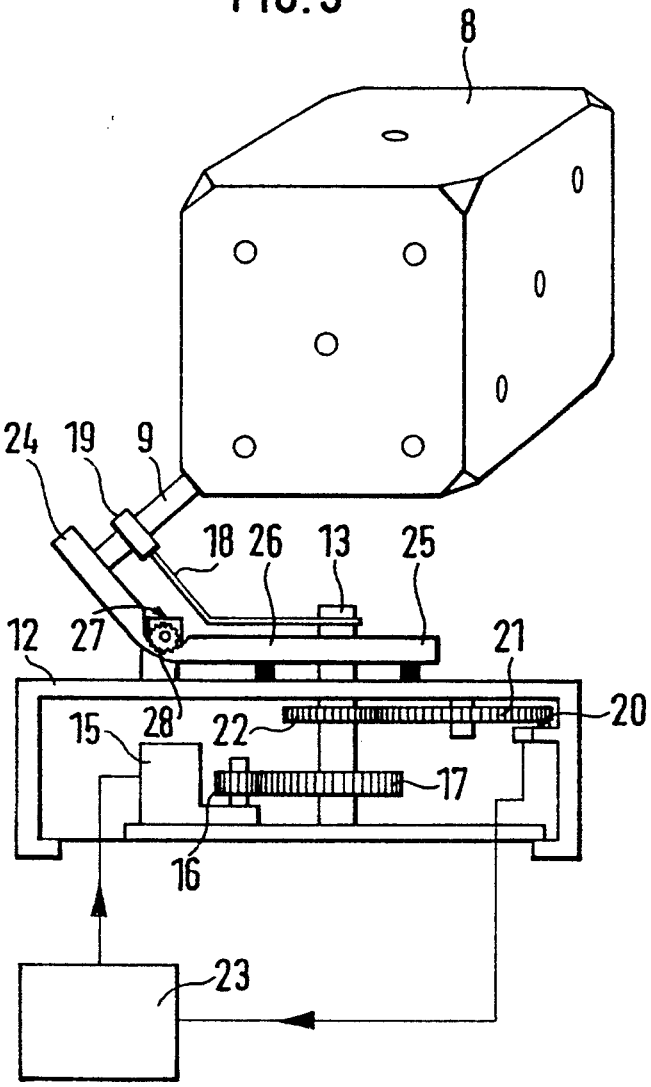
FIGS. 3 and 4 are diagrammatic views of a die with its drive mechanism according to a second embodiment of the invention.
Figure 4:
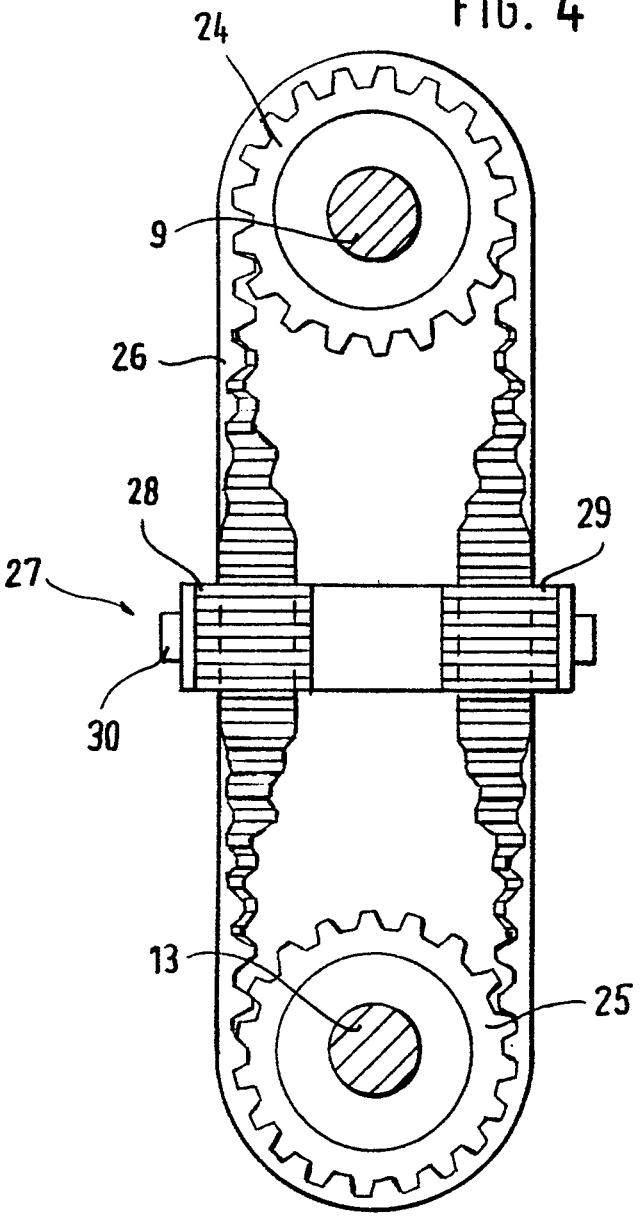

FIGS. 3 and 4 show another embodiment for driving the die 8, but only the differences compared with FIG. 2 will be explained. Otherwise this embodiment corresponds to that of FIG. 2. The embodiment of FIGS. 3 and 4 does not use bevel gears; but, instead, a first driving toothed gear 24 is firmly placed on the shaft 9 and a second driving toothed gear 25 is fixed to the frame 12 and through it passes the drive shaft 13. A toothed belt 26 is looped around the first and second driving toothed gears 24, 25 and is reversed at a reversing mechanism 27, which contains two toothed gears 28, 29 freely rotatably mounted on a shaft 30 attached to the crank 18. The toothed belt 26 is flexible so that such reversal is possible.

Due to the rotation of the crank 18 around the drive shaft 13, the toothed belt 26 is caused to rotate around the fixed second toothed gear 25. The rotating movement of the toothed belt 26 allows the rotation of the toothed gear 24 within the belt 26 such that the die 8 is rotated around its diagonal axis. In order that the toothed belt 26 is arranged in an optimum way around the toothed gears 24, 25 it has to be deviated at the bending point of the crank 18. The shaft 30 of the reversing mechanism 27 is fixedly located at that bending point and the two gears 28, 29 freely rotate around the shaft 30, respectively, in opposite directions when the toothed belt 26 is moving around the fixed second gear 25.

Figure 5:
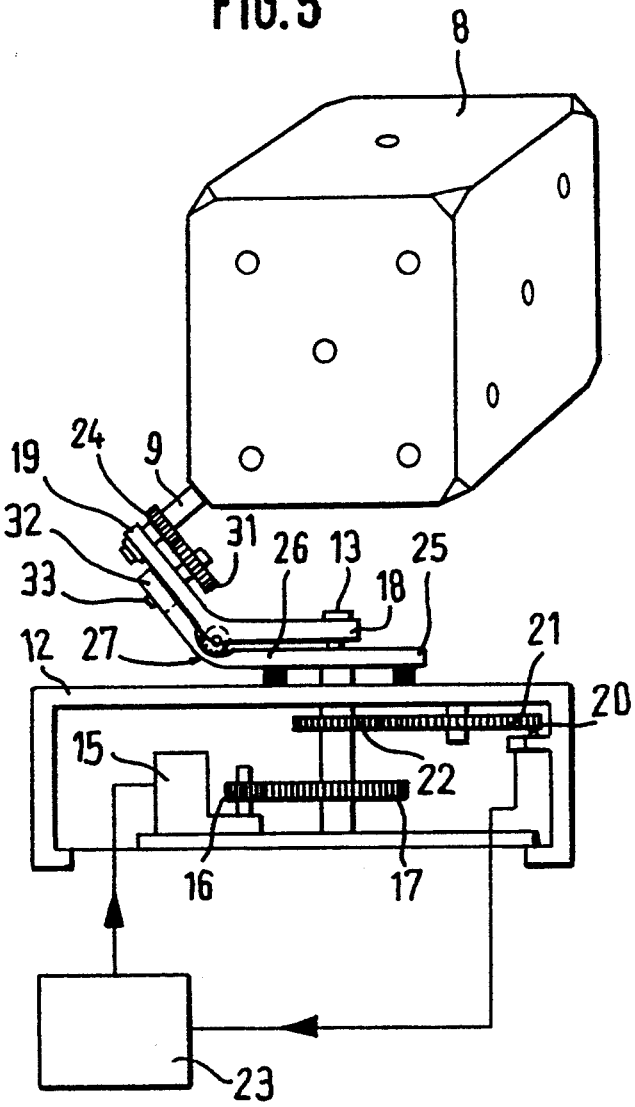
FIG. 5 is a diagrammatic view of a die with its drive mechanism according to a third embodiment of the invention.

FIG. 5 shows another embodiment for driving the die 8, but only the differences compared with FIG. 3 will be explained as this embodiment otherwise corresponds to that shown in FIG. 3. A third driving toothed gear 31 and a fourth driving toothed gear 32 are fixedly arranged on a common shaft 33 rotatably mounted on the crank 18 and respectively located adjacent to opposite sides of the crank 18. The third gear 31 engages the first driving toothed gear 24. The flexible toothed belt 26 is looped around the fourth gear 32 and the second driving toothed gear 25 fixed to the frame 12. The operation of this embodiment corresponds to that of FIG. 3 with the exception that the die 8 is turned around its diagonal axis in a direction opposite to that of FIG. 3.

In the gaming machine according to FIG. 1 there are three juxtaposed dies 8 as symbol carriers, but obviously a different number and arrangements could be chosen.

In another embodiment of the present invention the dice 8 with the corresponding drive mechanism is used directly as a die mechanism for party games and the like. For this purpose the control mechanism 23 is connected to a key, pushbutton or the like, which is operated by the player to start the die movement. Here again the dice 8 must be located below a display window in a clearly defined observation direction. On operating the not shown key on the part of the player, by means of a randomizer contained in the control mechanism, the latter determines the symbol which will be displayed at the end of the die movement and controls the dice 8 in the manner described hereinbefore on the position determined by the randomizer, i.e., on the given symbol. The duration of the dice movement is also determined by the control mechanism. Such a dice mechanism can also be provided for one or more dies 8 as a unit.

What is claimed is:

1. A drive mechanism for a symbol-carrying, rotary symbol carrier having a diagonal axis with a motor which rotates the symbol carrier, characterized in that a motor-gear combination drives the symbol carrier in such a way that it rotates about two rotation axes, a rotatable shaft is firmly connected to an extension of a diagonal axis of the symbol carrier, the shaft is connected by means of a bearing to a crank which is fixed to a rotated drive shaft, and the crank is bent in such a way that the shaft and the drive shaft are disposed at a predetermined angle with respect to each other.

2. The drive mechanism according to claim 1, characterized in that the motor-gear combination includes a first bevel gear and a second bevel gear, the first bevel gear being placed firmly on the shaft and the second bevel gear being stationary and centrally traversed by the drive shaft, and the first bevel gear engaging the second bevel gear.

3. The drive mechanism according to claim 2, characterized in that the transmission ratio of the first and second bevel gears is chosen in such a way that in the case of one or more $\frac{1}{4}$ rotations of the crank one or more, but not dividable by three, $\frac{1}{3}$ rotations of the shaft are performed.

4. The drive mechanism according to claim 2, characterized in that the first and second bevel gears form an angle of 126° to one another.

5. The drive mechanism according to claim 1, characterized in that the motor-gear combination includes a first driving toothed gear and a second driving toothed gear, the first driving toothed gear being placed firmly on the shaft and the second driving toothed gear being stationary and centrally traversed by the drive shaft, and a toothed belt passing around the first and second driving toothed gears.

6. The drive mechanism according to claim 3, characterized in that the first and second driving toothed gears form an angle of 126° to one another.

7. The drive mechanism according to claim 5, characterized in that the transmission ratio of the first and second driving toothed gears is chosen in such a way that in the case of one or more $\frac{1}{4}$ rotations of the crank one or more, but not dividable by three, $\frac{1}{3}$ rotations of the shaft are performed.

8. The drive mechanism according to claim 1 further comprising means for determining the reference position of one of the drive shaft and the crank.

9. The drive mechanism according to claim 1, characterized in that the motor is constructed as a stepping motor.

10. The drive mechanism according to claim 1, for use in a coin-operated gaming machine with a control and evaluating mechanism for controlling the drive mechanism, for rotating and stopping the symbol carrier and for evaluating the symbols visible on a display panel after stopping the symbol carrier to establish whether or not there has been a win.

11. The drive mechanism according to claim 10, characterized in that several symbol carriers are juxaposed and with each symbol carrier there is a motor-gear combination associated therewith.

12. The drive mechanism according to claim 1 for use in a die mechanism with at least one die, the dice being driven to perform die-typical movements, the drive mechanism being connected to a control mechanism.

13. The drive mechanism according to claim 12, characterized in that several dice are juxtaposed and a motor-gear combination is associated with each die.

14. The drive mechanism according to claim 1, characterized in that the motor-gear combination includes a first driving toothed gear and a second driving toothed gear, the first driving toothed gear being placed firmly on the shaft and the second driving toothed gear being stationary and centrally traversed by the drive shaft, a third driving toothed gear and a fourth driving toothed gear fixedly mounted on another shaft rotatably mounted on the crank, the third driving toothed gear engaging the first driving toothed gear, and a toothed belt passing around the second and fourth driving toothed gears.

15. The drive mechanism according to claim 14, characterized in that the first and second driving toothed gears form an angle of 126° to one another.

* * * * *